United States Patent [19]

Nieder

[11] 4,190,293

[45] Feb. 26, 1980

[54] ROCK SPLITTING ATTACHMENT FOR A BREAKING HAMMER

[76] Inventor: Charles E. Nieder, 134 N. Lyons Valley Rd., Jamul, Calif. 92035

[21] Appl. No.: 900,708

[22] Filed: Apr. 27, 1978

[51] Int. Cl.[2] ..... E21C 37/02; E21C 37/04

[52] U.S. Cl. ..... 299/23; 299/15; 166/216; 125/23 R; 254/104; 85/79

[58] Field of Search ..... 299/15, 20–23; 166/177, 178, 216, 217; 125/23 R; 254/104; 85/79

[56] References Cited

U.S. PATENT DOCUMENTS

| | | | |
|---|---|---|---|
| 1,407,719 | 2/1922 | Boner | 254/104 |
| 2,328,661 | 9/1943 | Maloney | 299/23 |
| 2,430,524 | 11/1947 | Miller | 85/79 X |

*Primary Examiner*—Ernest R. Purser
*Assistant Examiner*—Nick A. Nichols, Jr.
*Attorney, Agent, or Firm*—Charles C. Logan, II

[57] ABSTRACT

A rock splitting attachment for a breaking hammer comprising a primary shaft and an elongated primary wedge assembly that is telescopically attached to the primary shaft. The primary shaft has a plurality of principal wedge surfaces on its outer surface adjacent its bottom end. The structure for telescopically attaching the primary shaft to the elongated primary wedge assembly comprises a bore in the primary shaft extending axially inwardly from its bottom end and a secondary shaft that forms a part of the elongated primary wedge assembly. The width of the secondary shaft is smaller that the width of the bore so that it may be telescopically received therein. The secondary shaft has an external groove extending axially along a substantial portion of its length. A set screw is threadably seated in the primary shaft so that it extends radially inwardly far enough into the primary shaft that it extends into the external groove of the secondary shaft. The external groove is closed at its top end to prevent the secondary shaft from being pulled out of the bore of the primary shaft. The secondary shaft has a plurality of arms extending laterally from its lower end. The primary wedge assembly has a plurality of leg members each having a laterally oriented bore adjacent its lower end and each has one of the laterally extending arms of the secondary shaft received in its bore. The leg members have principal wedge surfaces on their inwardly facing sides.

9 Claims, 5 Drawing Figures

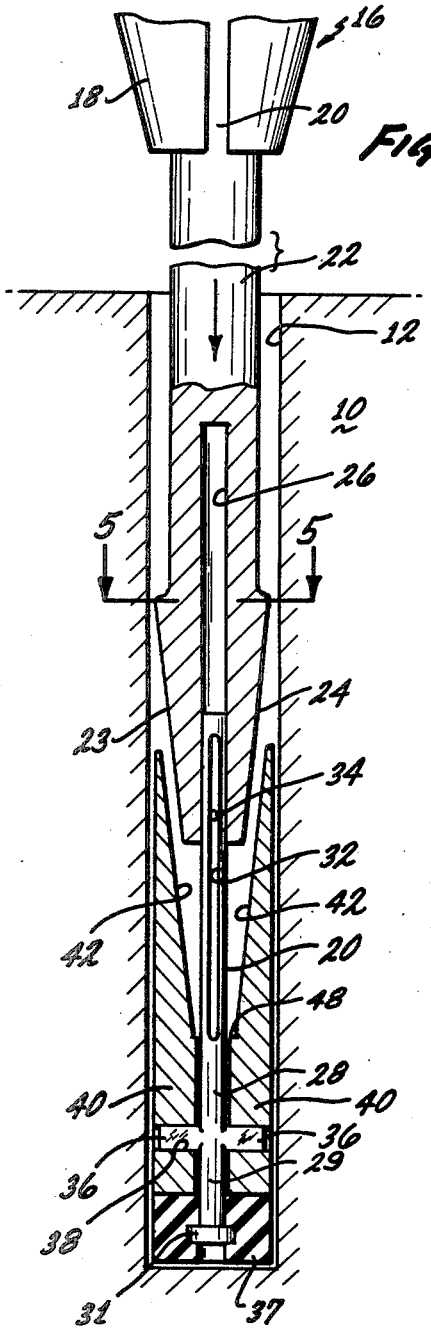
FIG. 1
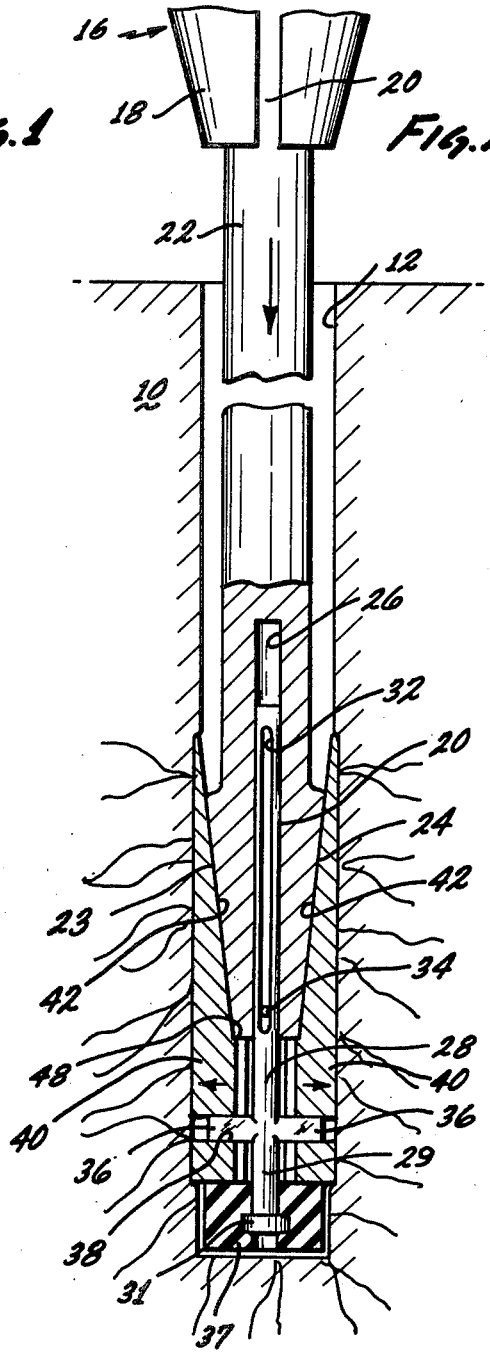
FIG. 2
FIG. 3
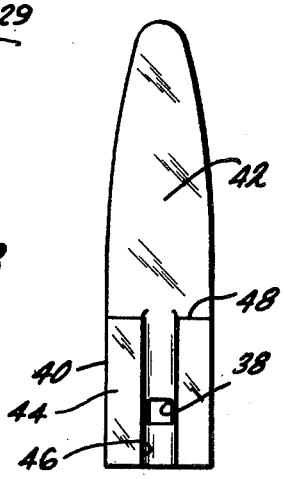
FIG. 4
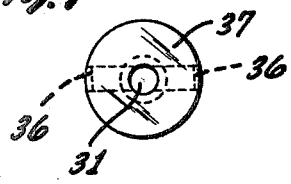
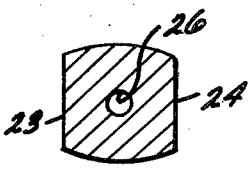
FIG. 5

ROCK SPLITTING ATTACHMENT FOR A BREAKING HAMMER

BACKGROUND OF THE INVENTION

The invention relates to an attachment for a breaking hammer that can be used to crack or split large rocks or used to break concrete slabs.

In the past, large rocks were split or cracked by the use of dynamite. When dynamite was used, it was necessary to drill bore holes in the rock into which a stick of dynamite was placed. An electric cap would have been attached to the stick of dynamite with the wires leading therefrom connected in a circuit containing a switch and a source of electricity.

One of the drawbacks to using dynamite to split or crack large rocks is the danger factor. If the blasting operation is to be performed in an area having buildings or homes in close proximity, it is necessary to cover the rock with a blasting mat to prevent the propulsion of pieces of rocks through the air in an uncontrolled manner. Special risks are created where the blasting operations take place near gas lines. Also if dynamite is being used a special magazine is needed to store or carry it to the job site. The result of the safety danger necessitates the obtaining of special permits to perform the blasting operations and also necessitates costly liability insurance. Liability insurance premiums are a prime factor in the high cost of conventional explosives use.

Another drawback to the use of dynamite to split large rocks is that it requires a trained expert to set the charge and explode it. In many cases this necessitates the hiring of a blasting contractor and delays may result from his having to fit your job into his schedule. Also special time consuming procedures are normally observed to insure safety and one of these is the requirement of moving personnel and/or equipment to a safer place while the blasting operation takes place. This in general results in production down time since the general work of the labor force is normally curtailed while the blasting operation takes place.

A third drawback to the use of dynamite as opposed to a machine or tool that will perform the same result is the cost factor. Currently a blasting cap costs approximately $0.70 each a charge of dynamite with the required useful force would cost about $0.15. Once the blasting operation occurs, these materials are lost and cannot be used again. If a tool or machine is utilized to perform the operation, it can normally be used again and again.

A fourth drawback to the use of explosives for cracking or splitting large rocks is the relatively long time required to perform the preparation work. The charges are normally set in holes which have been drilled approximately four feet into the rock. The time required for drilling the first two feet of the hole takes about four minutes. To perform the next two feet of drilling requires more than twice that amount of time. One reason for this is the loss of hammering power due to the dampening effect on the longer shaft. An additional factor is the loss of sufficient air volume and pressure to exhaust chips from the bottom of the hole resulting in loss of drilling efficiency due to the padding effect caused by the chips that aren't removed quickly enough. When the long drilling time for one of these holes is multiplied times the number of holes that would be drilled in cracking a large rock, the total time becomes very substantial.

A fifth drawback to the use of dynamite for splitting large rocks is the environmental aspect. The use of dynamite results in the release of poisonous gases into the air. Also it results in dust being stirred up into the atmosphere.

It is an object of the invention to provide a device for splitting large rocks that will not throw debris or send massive uncontrolled shock waves throughout the surrounding area.

It is also an object of the invention to provide a device for splitting large rocks that will eliminate the use of dynamite with its attendant dangers.

It is also an object of the invention to provide a device for splitting large rocks that will not necessitate the movement of personnel and/or equipment to a safer place while the device is in operation.

It is also an object of the invention to provide a device for splitting large rocks that would not disturb the surrounding area or loosen the walls of a ditch or tunnel in close proximity thereto thus exposing personnel to unnecessary cave-in hazards.

It is also an object of the invention to provide a device for splitting large rocks that does not require the person performing the operation to have extensive special knowledge such as is required of an explosive expert.

It is also an object of the invention to provide a device for splitting large rocks that does not release any poisonous gases or throw any dust into the air.

It is a further object of the invention to provide a device for splitting large rocks that will eliminate the need for liability insurance premiums such as are necessitated by the use of dynamite.

It is an additional object of the invention to provide a device for splitting large rocks that can be used over and over again thereby cutting down the cost of such an operation.

It is an additional object of the invention to provide a device that can be used to break concrete slabs and one which will allow the operator to have directional control over the fracture produced by the device.

SUMMARY OF THE INVENTION

The novel rock splitting attachment for a breaking hammer would be detachably secured to the chuck of the breaking hammer. Preparatory to use of the device, a plurality of holes would have been drilled into the rock at predetermined locations along its surface. A typical operation would be to drill the holes approximately 10" apart in a single line, and to a depth of approximately 12". One of the rock splitting attachments would be driven into each of the holes with the cumulative force causing the rock to break apart.

The operation of one of these rock splitting attachments will now be described. Once the primary shaft of the attachment has been secured in the chuck of the breaking hammer, the primary shaft and the primary wedge assembly which is attached to the lower end of the primary shaft are lowered into the drilled bore hole. The air valve for starting the operation of the breaking hammer is then opened causing the hammer to exert a downward force on the primary shaft which causes the wedge-shaped leg members to be forced outwardly against the walls of the bore hole. The continual reciprocating motion given to the primary shaft by the breaking hammer causes internal concussion and driving force to be transmitted from the breaking hammer down through the primary shaft and against the walls of the bore holes resulting in internally originated fractures perpendicular to the contact of the wedge-shaped leg members against the walls of the bore hole.

When it is desired to remove the rock splitting attachment from the bore hole, it is only necessary to pull upwardly on the primary shaft causing it to telescope away from the primary wedge assembly. This action allows the wedge-shaped leg members to contract toward each other to allow for easy removal of the attachment.

When the rock splitting attachment is used to break a concrete slab, the bore holes are drilled into the slab in a predetermined pattern. This allows the operator to maintain directional control of the fracture which is critical when removing a section of sidewalk or curb. By using applicant's novel device there is less time required to drill and split the sidewalk than would be required to peen away at it with a point or spade.

DESCRIPTION OF THE DRAWINGS

FIG. 1 is a side elevation view illustrating the rock splitting attachment partially in cross-section as it is initially inserted into the bore hole;

FIG. 2 is a side elevation view illustrating the rock splitting attachment in partial cross-section illustrating the attachment as it functions to fracture the rock;

FIG. 3 is a side elevation view of one of the wedge-shaped leg members;

FIG. 4 is a bottom view of the attachment; and

FIG. 5 is a cross-section taken along lines 5—5 of FIG. 1.

DESCRIPTION OF THE PREFERRED EMBODIMENT

The rock splitting attachment will be described by referring to FIGS. 1 through 5. The numeral 10 generally designates the rock to be split and element 12 is a bore hole in that rock. The bottom of a breaking hammer 16 is illustrated with its chuck member 18 fixedly gripping the shank 20 of primary shaft 22 of the rock splitting attachment.

The primary shaft 22 has a pair of principal wedge surfaces 23 and 24 adjacent its bottom end. These principal wedge surfaces 23 and 24 are on the outer surface of the primary shaft 22.

A bore 26 in the bottom end of the primary shaft 22 extends axially inwardly. Received within bore 26 is a secondary shaft 28 that forms a part of the elongated primary wedge assembly 30. The width of the secondary shaft 28 is slightly smaller than the width of the bore so that it may be telescopically received therein. A groove 32 in the secondary shaft 28 forms a portion of the structure for preventing the de-coupling of the secondary shaft from the primary shaft. A set screw 34 is threadably seated in the primary shaft 22 so that it extends radially inwardly far enough into groove 32 to be captured by the closed end of the groove at its top end to prevent the secondary shaft 28 from being pulled out of the bore 26.

The bottom of the secondary shaft 28 has a pluralty of arms 36 extending laterally from its lower end. These arms 36 are received in bores 38 found at the lower end of wedge-shaped leg members 40. The cross-section of these laterally extending arms 36 and the bores 38 in which they are received are of a predetermined shape, such as a square to prevent the legs from rotating about the axis of the laterally extending arms. Below the laterally extending arms 36, the secondary shaft 28 has an extension member 29 with a knob 31 on its end. The knob on the extension member snaps into a rubber protector boot 37 that functions to protect the bottom of the primary wedge assembly 30 from shock.

The wedge-shaped members 40 have their principal wedge surfaces 42 on their inwardly facing side with the taper of the principal wedge surfaces being such that the thinnest portion is adjacent to the top of the legs. The leg members also have a raised portion 44 on their inwardly facing side adjacent their bottom end that has an axially groove 46 for receiving the secondary shaft 28 when the elongated primary wedge assembly 30 is in its contracted state.

By referred to FIGS. 1 and 2 it can be seen that as the primary shaft 22 is driven downwardly, its principal wedge surfaces 23 and 24 will contact and travel along the principal wedge surfaces 42 of the elongated primary wedge assembly causing the wedge-shaped leg members 40 to be driven radially outwardly thus increasing the width of the elongated primary wedge assembly with the result that the internal concussion and driving force exerted on the primary shaft by the breaking hammer is directed against the walls of the bore holes causing internal fractures in the rock.

The leg members 40 have a primary shaft limit surface 48 that limits the axial movement of the primary shaft 22 into the primary wedge assembly 30.

What is claimed is:

1. A rock splitting attachment for a breaking hammer comprising:

a primary shaft having first wedge means adjacent one of its ends, said first wedge means having a plurality of principal wedge surfaces on the outer surfaces of said primary shaft, an elongated primary wedge assembly having second wedge means formed adjacent one of its ends, said second wedge means having a plurality of principal wedge surfaces on the interior surfaces of said elongated primary wedge assembly, means for telescopically attaching said primary shaft to said elongated primary wedge assembly whereby when said primary shaft is driven axially toward said elongated primary wedge assembly while the elongated primary wedge assembly's axial movement has been restrained, said principal wedge surfaces of said primary shaft will contact and travel along said principal wedge surfaces of said elongated primary wedge assembly to be driven radially outwardly thus increasing the width of said elongated primary wedge assembly with the result that the internal concussion and driving force exerted on said primary shaft by a breaking hammer is directed against the walls of a bore hole into which said rock splitting attachment has been inserted causing internal fractures in the rock, said means for telescopically attaching said primary shaft to said elongated primary wedge assembly comprises:

a bore in said primary shaft extending axially inwardly from that end of the primary shaft which has the first wedge means adjacent thereto, and a secondary shaft that forms a part of said elongated primary wedge assembly, the width of said secondary shaft being smaller than the width of said bore so that it may be telescopically received therein.

2. A rock splitting attachment for a breaking hammer as recited in claim 1 wherein said means for telescopically attaching said primary shaft to said elongated primary wedge assembly further comprises means for preventing the de-coupling of said secondary shaft from said primary shaft.

3. A rock splitting attachment for a breaking hammer as recited in claim 2 wherein said means for preventing the de-coupling of said secondary shaft from said primary shaft comprises an external groove in the surface of said secondary shaft extending axially along a substantial portion of its length and a set screw that is threadable seated in said primary shaft so that said set screw extends radially inwardly far enough into said primary shaft that it extends into the external groove of said secondary shaft, said external groove being closed at its top end to prevent said secondary shaft from being pulled out of the bore of said primary shaft.

4. A rock splitting attachment for a breaking hammer as recited in claim 1 wherein said secondary shaft has a plurality of arms extending laterally from its lower end.

5. A rock splitting attachment for a breaking hammer as recited in claim 4 wherein said primary wedge assembly further comprises a plurality of leg members each having a laterally oriented bore adjacent one of its ends and each having one of the laterally extending arms of said secondary shaft received in its bore.

6. A rock splitting attachment for a breaking hammer as recited in claim 5 wherein the cross section of said laterally extending arms and the bores in which they are received are of a predetermined shape to prevent said legs from rotating about the axis of said laterally extending arms.

7. A rock splitting attachment for a breaking hammer as recited in claim 5 wherein said leg members have said principal wedge surfaces on their inwardly facing sides with the taper of said principal wedge surfaces being such that their thinnest portion is adjacent the top of said legs.

8. A rock splitting attachment for a breaking hammer as recited in claim 7 wherein said leg members have a raised portion on their inwardly facing sides adjacent their bottom ends that has an axial groove for receiving said secondary shaft when said elongated primary wedge assembly is in its contracted state.

9. A rock splitting attachment for a breaking hammer as recited in claim 8 wherein said leg members have a primary shaft limit surface to limit the axial movement of said primary shaft into said primary wedge assembly.

* * * * *